US005539953A

United States Patent [19]

Kurz

[11] Patent Number: 5,539,953

[45] Date of Patent: Jul. 30, 1996

[54] FLOOR NOZZLE FOR VACUUM CLEANERS

[76] Inventor: Gerhard Kurz, Bruckenäcker 11, W-7000 Stuttgart 80, Germany

[21] Appl. No.: 443,102

[22] Filed: May 17, 1995

Related U.S. Application Data

[63] Continuation of Ser. No. 7,145, Jan. 21, 1993, abandoned.

[30] Foreign Application Priority Data

Jan. 22, 1992 [DE] Germany ..... 42 01 596.0

[51] Int. Cl.[6] ..... A47L 9/06

[52] U.S. Cl. ..... 15/367; 15/373; 15/398; 15/402; 15/420

[58] Field of Search ..... 15/398, 400, 401, 15/402, 367, 373, 420

[56] References Cited

U.S. PATENT DOCUMENTS

| | | | |
|---|---|---|---|
| 850,909 | 4/1907 | Diserens | 15/401 |
| 886,290 | 8/1908 | Freeman | 15/401 |
| 1,238,903 | 9/1917 | Fisher | 15/402 X |
| 2,157,077 | 5/1939 | Kroenlein | 15/420 X |
| 2,703,903 | 3/1955 | Faith-Ell | 15/367 X |
| 2,703,905 | 3/1955 | Faith-Ell | 15/401 X |
| 3,550,183 | 12/1970 | Wolf | 15/420 X |
| 3,952,363 | 4/1976 | Lindmann | 15/373 |
| 4,014,068 | 3/1977 | Payne et al. | 15/373 X |
| 4,073,031 | 2/1978 | Schwartz | 15/373 |
| 4,888,852 | 12/1989 | Varin | 15/373 X |

FOREIGN PATENT DOCUMENTS

| | | |
|---|---|---|
| 236595 | 10/1964 | Austria . |
| 0163772 | 12/1985 | European Pat. Off. . |
| 3228644 | 2/1984 | Germany . |
| 3241213 | 5/1984 | Germany . |
| 3431164 | 8/1985 | Germany . |
| 8809802 | 1/1990 | Germany . |
| 2200538 | 8/1988 | United Kingdom . |

OTHER PUBLICATIONS

Patent Abstracts of Japan, vol. 14, No. 403 (C–753) 31 Aug. 1990 & JP–A–21 52 420 (Matsushita Electric Ind Co) 12 Jun. 1990.

Patent Abstracts of Japan, vol. 14, No. 417 (C–756) 10 Sep. 1990 & JP–A–21 59 232 (Matsushita Electric Ind Co).

Patent Abstracts of Japan, vol. 15, No. 440 (C–883) 11 Nov. 1991 & JP–A–31 86 243 (Matsushita Electric Ind Co) 14 Aug. 1991.

Patent Abstracts of Japan, vol. 16, No. 001 (C–899) 9 Oct. 1991 & JP–A–32 28 724 (Matsushita Electric Ind Co).

*Primary Examiner*—Chris K. Moore

*Attorney, Agent, or Firm*—Darby & Darby, P.C.

[57] ABSTRACT

A floor nozzle for vacuum cleaners comprises a housing and two suction channels, separated by an intermediate strip, arranged in the bottom plate thereof and extending transversely to the direction of movement the intermediate strip being designed as a rigid plow strip arranged between a front and a rear cleaning edge and acting to open the nap to be cleaned, due to its digging-in effect, toward the front or rear suction channel, depending on the direction of movement.

23 Claims, 7 Drawing Sheets

FLOOR NOZZLE FOR VACUUM CLEANERS

This is a continuation of application Ser. No. 08/007,145, filed Jan. 21, 1993 now abandoned.

BACKGROUND OF THE INVENTION

The invention relates to a floor nozzle for vacuum cleaners.

A known floor nozzle of this kind (DE-GM 73 43 139) comprises a suction channel arranged in the front area of the lower nozzle part and extending over the width of the nozzle. In its central area, the suction channel is divided into two partial channels by a flexible or elastic cross-piece, the latter being interrupted in the area of the suction opening in the bottom piece of the floor nozzle. In its rest position, the elastic strip projects a little beyond the bottom of the nozzle which enables it, due to its elasticity, to yield in the direction of movement, i.e. to turn in a forward or backward direction so that it comes to apply itself flat upon the entire surface to be cleaned, which effect can be achieved even on irregular surfaces. The main reason for giving the cross-piece this elastic design is to enable the cross-piece, which preferably consists of an elastic material, to give way laterally; thus, less pushing force is required as the cross-piece simply turns to the rear as viewed in the pushing direction.

According to another known design (DE-GM 19 43 044) of a vacuum cleaner nozzle it has been known to provide two suction slots arranged one behind the other in the working direction of the nozzle. In this case the suction slots slide on the surface to be cleaned by their leading and trailing longitudinal edges, while the inner longitudinal edges of the suction slots include between them an air channel which extends over the full width of the nozzle and is open on the narrow ends thereof. It is the purpose of this arrangement to enable the air to freely enter this central intermediate channel—which is not connected to the suction opening of the nozzle—from both sides and be taken in through the suction slots practically from the inside. This has the practical effect of guiding the suction flow toward the suction opening across four longitudinal edges that slide on the surface to be cleaned and that, besides, all lie in one and the same plane.

In addition, the outwardly open, free intermediate air channel may be equipped with some conventional lint pickup means, for example in the form of a comb.

The problem encountered with conventional suction nozzles, in particular when cleaning rugs or other deep-pile materials, namely to separate the nap so as to achieve a deep cleaning effect, cannot be achieved in this way as both the elastic cross-piece according to DE-GM 73 43 139 and necessarily also the four longitudinal edges of DE-GM 19 43 044 only slide on the surface to be cleaned and do not have the effect to separate its nap.

Still other embodiments of known floor nozzles for vacuum cleaners have been described by the following publications according to DE-OS 32 41 213, DE-OS 29 39 353, EP 01 63 772, DE-=OS 32 28 644, AT 236 595, DE-GM 88 09 802, GB 22 00 538, DE-OS 34 31 164 and DE-GM 78 13 344.

The design described by DE-OS 32 41 213 comprises adjustable runners including between them strips provided each with a soft coating. The runners serve as carrier elements which, in the rest position, are set back relative to the supporting surfaces of the strips by the same predetermined amount by which they project beyond the same supporting surface in their operative position. Inside the strips, channels extending transversely to the longitudinal axis are provided in staggered arrangement, as between neighboring strips.

From DE-GM 88 09 802 it has been further known to design a vacuum cleaner nozzle, which is supported on rear support rollers 9, in such a way that the swivel axis for a coupling pipe is located vertically above the axis of rotation of the support wheel, while the tilt axis of the nozzle opening is located below the axis of rotation of the support wheels and —in horizontal direction—before these support wheels in the direction of the longitudinal center axis. Thus, pushing of the vacuum cleaner nozzle will simultaneously result in an overturning moment acting on an intermediate channel piece. This overturning moment will produce at the nozzle a vertical force acting in a downward direction, which is transmitted to the nozzle piece via the tilt axis so as to press the nozzle piece against the surface to be cleaned. However, the operator cannot in this case—as is sometimes tried—apply more pressure on the coupling pipe, by means of which the vacuum cleaner nozzle is moved across the floor by the operator, in order to press it more firmly against the surface to be worked—which would of course be desirable—as all forces exerted by the operator in downward direction are absorbed by the support wheels. In the case of another known vacuum cleaner nozzle (DE-OS 28 17 512), suction channels opening in a fork-like manner extend on both sides of a central suction opening in the bottom plate which transitions into the pivotal suction pipe, via an exhaust channel. The suction channels are configured as recessed portions in the bottom plate and are surrounded on all sides by surfaces which in the rug-cleaning position simultaneously serve as support surfaces for the nozzle plate. At the front and at the rear—viewed in the pushing direction—a retractable hard-floor brush strip extends over the full width of the vacuum cleaner nozzle, and in addition a usual lint pickup rectangle made from a carpet-like fabric with inclined bristles is provided behind the suction opening as viewed in the forward pushing direction.

In the case of another vacuum cleaner nozzle according to European Patent Specification No. 0 151 739, a pair of wheels of the kind normally provided for supporting the pipe connecting the handle with the intake pipe and the floor nozzle, is arranged coaxially with the pivot axis of the suction pipe, which latter is articulated on the floor nozzle. It is to be ensured in this way that the depth of penetration of the working edges defining the suction opening will be optimally adapted to different floorings and, especially, cannot be influenced by the force applied on the nozzle. Such a floor nozzle does not, therefore, respond to the force exerted by the user during the cleaning operation by penetrating deeper into or applying itself more strongly upon the floor to be cleaned, since the force so applied is completely absorbed by the pair of support wheels. This may, however, be a problem under certain circumstances when the user intentionally tries to increase the cleaning effect by applying more pressure.

It has further been known (European Patent Specification No. 0 163 772) to simplify the vertical adjustment of the brush strip arranged in front of the forward working edge of the nozzle base by disposing the brush strip on a rocker arm pivotally mounted in the rear area of the nozzle housing. The position of the rocker arm can be changed in the usual way by means of an actuator element provided on the nozzle housing, whereafter the rocker arm can be locked in the respective new position. The different positions of brush strip, thread or lint pickup means, which are adjustable in the present case, and of certain support surfaces relative to each other are firmly predetermined by the fact that three control slides are united to a single control member by connection pieces so that when one of the control elements is adjusted, the different operating elements of the vacuum cleaner nozzle will all be moved into relative positions determined by the geometry by the different interconnected control slides.

Now, it is the object of the present invention to achieve a substantial improvement of the cleaning effect of a floor nozzle for vacuum cleaners, especially in connection with nap floorings.

SUMMARY OF THE INVENTION

The invention provides an especially good cleaning effect for nap floorings, even if they are heavily soiled, with the same low, in any case not notably increased, pushing force, since in the case of the two suction channels provided in this case a rigid central "plow strip" acts to sort of plow up the nap, while air is effectively drawn in from both sides of that central strip.

The central strip sort of digs itself into the nap, and as the floor nozzle is moved to and fro when working the floor, this has the effect that the upright fibers of the nap are successively bent off, i.e. are flung open, while suction continues to be effective on both sides, and are then released again by the central strip and returned to their normal position, whereby extremely fine dust particles are sort of thrown off the threads and fibers and are then carried off by the strong vacuum effect prevailing on both sides of the central plow strip, over the full width of the floor nozzle.

This provides the further advantage that the digging-in effect is further supported by the rigid configuration of the plow strip as a central cleaning edge, which gets very narrow toward the bottom and which additionally may be given a comb-like design. Further, there are provided additional cleaning edges on both sides, i.e. in front and toward the rear, so that two parallel suction channels are obtained which extend over the whole width of the floor nozzle and in which the desired suction effect can be optimally produced through a large central suction opening which opens separately into the two suction channels and which may, if desired, be provided with inclined connection surfaces so as to produce a funnel-shaped design in order to better control the air circulation. Thus, in operation of the vacuum cleaner, at least two of the three cleaning edges—counting also the plow strip—will always give optimum performance, the third will give good cleaning performance.

A further advantage arises by displacing the axis of the swivel coupling by a predetermined amount in horizontal direction, relative to the support wheels or the wheel bearing axle. Thus, the user is given the possibility to apply increased contact pressure on the nozzle, at least during forward movement of the latter, by exerting greater pressure on the handle, so that it is now possible for the user, by intentionally exerting additional force, to press the floor nozzle base more strongly upon the floor in order to reinforce the digging-in effect of the cleaning edges and to thereby increase the suction force acting on the surface to be cleaned. On the other hand, the offset of the axis is confined to predetermined limits, which means that the user's efforts are limited, too, so that excessive digging-in, with the resulting excessive braking effect in operation of the floor nozzle, is prevented.

According to an advantageous embodiment of the invention, the bottom plate forms sort of a closed suction space, due to a sealing lip which projects in downward direction, enclosing practically the full rear area, while toward the front, i.e. in the pushing direction, viewed from the user's standpoint, it joins the forward cleaning edges and merges with the latter so that a practically closed suction space is obtained, which is of particular importance when cleaning hard floorings.

This closed suction space opens only on both sides of the suction channel, by openings which are specifically sized and tuned to the general behavior of the floor nozzle.

This almost fully closed suction space leads to the further advantage that the air flows at high velocity—viewed over the whole width of the floor nozzle—across the forward and rear cleaning edge, respectively, and toward the central plow strip.

Since according to another advantage of the invention the forward and rear cleaning edges, which enclose between them the two suction channels at the front and at the rear, are rounded at their bottoms, the air drawn in can pass below these rounded suction edges near the carpet backing, so that the best possible cleaning effect is obtained deep in the carpet and then additionally and especially behind the plow strip which functions as a nap-separating rib.

Another advantage a rises when all movable parts are supported via cranked axle stubs for the support wheels, the cranked portion serving to ensure the setoff of the axes of the swivel coupling and the wheel bearing. In this connection, a rocker or pivot plate carrying an additional brush strip has at least two, according to an advantageous embodiment four, bearing arms reaching back to the axle stubs for the wheel bearings, and enclose the latter outside the support wheels in the manner of a fork, thus forming the rear pivot point for the pivot plate. Simultaneously the rocker or pivot plate secures the axle stubs in their position, as the pivot arms of the pivot plate, which open in the form or a fork, are snapped on the cranked axle stubs, thus forming snap rings for the axle stubs.

Another feature of the present invention is in the area of the suction hole, which opens into the two suction channels. The vacuum channel leading from the articulated suction pipe and through the floor nozzle is defined by corresponding inclined surfaces which ensure that the air is not deflected at a right angle, but rather along a gradually inclined transition so that the least possible system losses and eddy currents are produced in this area whereby the vacuum effect propagating into the suction channels is significantly increased and improved.

According to another feature of the invention, a rocker seated in the upper part of the floor nozzle enables the position of the pivot plate to be changed depending on the kind of flooring to be worked. The rocker consists of a pipe which is bent off several times and which extends over the width of the floor nozzle, and is supported in bearing blocks at different points and provided with webs which, when the rocker is pivoted, exert a cam-like effect on both sides of the pivot plate. Such a cam-like effect pushes the pivot plate down, uniformly and without the plate becoming skewed, so that the brush strip is permitted to emerge from the bottom plate. At the same time, an indication device visible through the transparent plastic material on the side opposite the rocker indicates the respective position of the rocker and, thus, of the pivot plate to show if at the particular time the floor nozzle is in a position suited for forking hard flooring or nap flooring.

Another feature of the invention relates generally to the simple structure of the floor nozzle, which consists of only cleaner nozzle, consists essentially of three main parts, namely the upper cover part 11 visible in FIG. 1, a central pivot plate 12 (FIG. 5), which also and especially carries a front brush strip 13 and which is shown in greater detail in FIGS. 5 to 9, and a lower bottom plate 14, also described as nozzle base or lower nozzle plate.

Referring initially to FIG. 2, one can see a bottom view of the floor nozzle 10 illustrating mainly details of the bottom plate 14.

It should be noted initially that the terms front and rear and backward, which will be frequently used hereafter, relate to the direction of the movement which the floor nozzle performs when it is moved by an operator via the handle—which is fixed to the suction pipe 15, but not shown in the drawing—in forward direction, i.e. away from the user. Rear or back means adjacent to the suction pipe 15. The floor nozzle comprises at least two suction channels 16*a*, 16*b* which are separated from each other, extend over the whole width and open at the center (separately) into a common suction hole 17. Both suction channels 16*a*, 16*b* are enclosed by cleaning edges, including a continuous central strip with a double-acting cleaning edge 18. This central strip, which will be described hereafter as the plow strip, also clearly separates the two suction channels 16*a*, 16*b*, also with respect to the air flows. As can be seen in the drawing, each of the suction channels 16*a*, 16*b* opens separately into an especially assigned partial suction hole 17*a*", 17*b*" that are united to the common suction hole 17.

At the front and at the rear, the two suction channels 16*a*, 16*b*, are delimited by additional cleaning edges, namely a front cleaning edge 19 and a rear cleaning edge 20. In the case of the embodiment illustrated in FIG. 2, these cleaning edges may also be interrupted centrally by a front lint pickup pad 21 and a rear lint pickup pad 22. These lint pickup means 21, 22 usually consist of a conventional suitable, carpet-like fabric with inclined bristles, or the like. Compared with the cleaning edges 19, 20 and the plow strip 18, the surfaces of the lint pickup means are slightly set back to the inside of the brush. Except for these arrangements, there do not exist any other protruding sliding surfaces in the area of the nozzle base that could prevent the digging-in effect of the plow strip.

In the case of the illustrated embodiment, the two lint pickup means 21, 22 interrupt the continuous configuration of the front and rear cleaning edges 19 and 20 so as to divide them into partial elements 19*a*, 19*b* and 20*a*, 20*b*, respectively. The suction hole 17 opens into the suction channels 16*a*, 16*b* by funnel-shaped transitions provided on both sides so that each of the partial suction holes 17*a*, 17*b* forms a suction slope 23. In front of the forward cleaning edge 19, there is arranged the before-mentioned brush strip 13 which as such is of the retractable type and supported for this purpose on the movable pivot plate, not visible in FIG. 2.

The bottom plate is recessed into the upper cover part 11, of which only the outer continuous marginal edge 11*a* is visible in FIG. 2. Reference numeral 26 designates screw holes that may be provided at any position for screwing the bottom plate to the cover part, preferably by means of cylinder-like projecting screw studs fixed to the upper cover part.

The suction channels 16*a*, 16*b* may be further provided, on the narrow sides of the floor nozzle, with marginal openings 27 tuned to their size in order to facilitate at these points the intake of air from the outside.

The bottom plate consists preferably of a single plastic part, preferably an injection-molded part, where the remaining surfaces—i.e. the surfaces not mentioned before —are set back relative to the cleaning edges so that the latter are the only parts of the bottom plate to project in downward direction in the normal position of the floor nozzle, thereby forming the sliding surfaces. For cleaning hard floorings, the brush strip 13 is lowered, as usual with such floor nozzles. The cleaning edges 19, 20, may taper toward the bottom, thereby forming run-up slopes on one or on both sides; preferably, however, they are rounded (see FIG. 11) which gives the floor nozzle satisfactory sliding properties also on heavy pile-like floorings. In this connection, the central web of the central plow strip 18 is of great importance for the significantly improved dirt and dust removal capacity; this is so because the plow strip 18 penetrates into the pile in both directions of movement, breaks it up, bends the individual fibers over according to its direction of movement, and separates the nap either in the direction of the front suction channel 16*a* or the rear suction channel 16*b* so as to produce optimum dust removal conditions during both forward and backward movement of the floor nozzle. Reference is made to the function chart of FIG. 11, where it can be seen that the rounded areas 25 of the front cleaning edge 19 and the rear cleaning edge 20 ensure on the one hand that only little pushing force is required in both directions and, on the other hand, due to an almost rightly enclosed suction space, that the air is capable of flowing into the suction channels 16*a*, 16*b* past the rounded suction edges and close to the carpet backing so that the best possible cleaning effect is achieved in combination with the nap-separating effect of the plow strip 18. While the two front and rear cleaning edges 19 and 20 slide across the nap, due to their rounded configuration, and enable air to flow through the nap close to the carpet backing, it can be seen that the more pointed plow strip 18, which exhibits a comb-like configuration, separates the fibers of the nap down to the bottom of the carpet so that a particularly good and deep effect is achieved. During forward movement, the front cleaning edge 19 separates that nap area which is being worked or covered at any time in the direction of the suction channel 16*a*, while the central double-acting plow strip 18 separates the nap in the direction of the suction channel 16*b*. During the return movement of the floor nozzle 10, the action in the other way round. During both movements, however, both suction channels are fully active, and there are always two of the cleaning edges contributing to the nap cleaning operation so that particularly effective and efficient cleaning and dust removal is attained without any of the directions of movement being at a disadvantage.

This effect is especially due to the fact that no other contact or sliding surfaces contribute to the floor contact of the bottom plate 14, except for the support wheels which will be described further below but which are arranged outside the sealing area.

The configuration of the accommodation for the support wheels 28*a*, 28*b* on both sides is visible in the illustration of FIG. 2. To form this accommodation, the marginal edge 11*a* of the cover part 11 is sort of folded back in the bearing area for the support wheels so as to form, adjacent to double passage bores 29*a*, 29*b* on both sides of each of the support wheels, between the two wall portions 11*a*' and 11*a*" (FIG. 2) accommodation spaces 20 into which there project the ends of the—in the present case four—rocker arms 12*a*, 12*b*, 12*c* and 12*d* of the pivot plate 12 (see also FIGS. 5 to 8). This arrangement will be discussed in more detail further below. The support wheels are supported on cranked axle stubs 31 which are received and held in the wall portions 11*a*', 11*a*" on both sides of the housing, as can be seen best on the right side of the illustration of FIG. 3.

three or, counting also the two support wheels with their axles, of five components that are reinforced and matched one to the other by suitable configuration of the different housing and plate components—all of which are made from plastic—so that no important input is required for their assembly.

BRIEF DESCRIPTION OF THE DRAWING

Certain embodiments of the invention will be described hereafter by reference to the drawing, in which:

FIG. 10 shows a top view of the double-cranked actuator axle for the actuator means of the pivot plate, while

DESCRIPTION OF THE EMBODIMENTS

Figure 1:
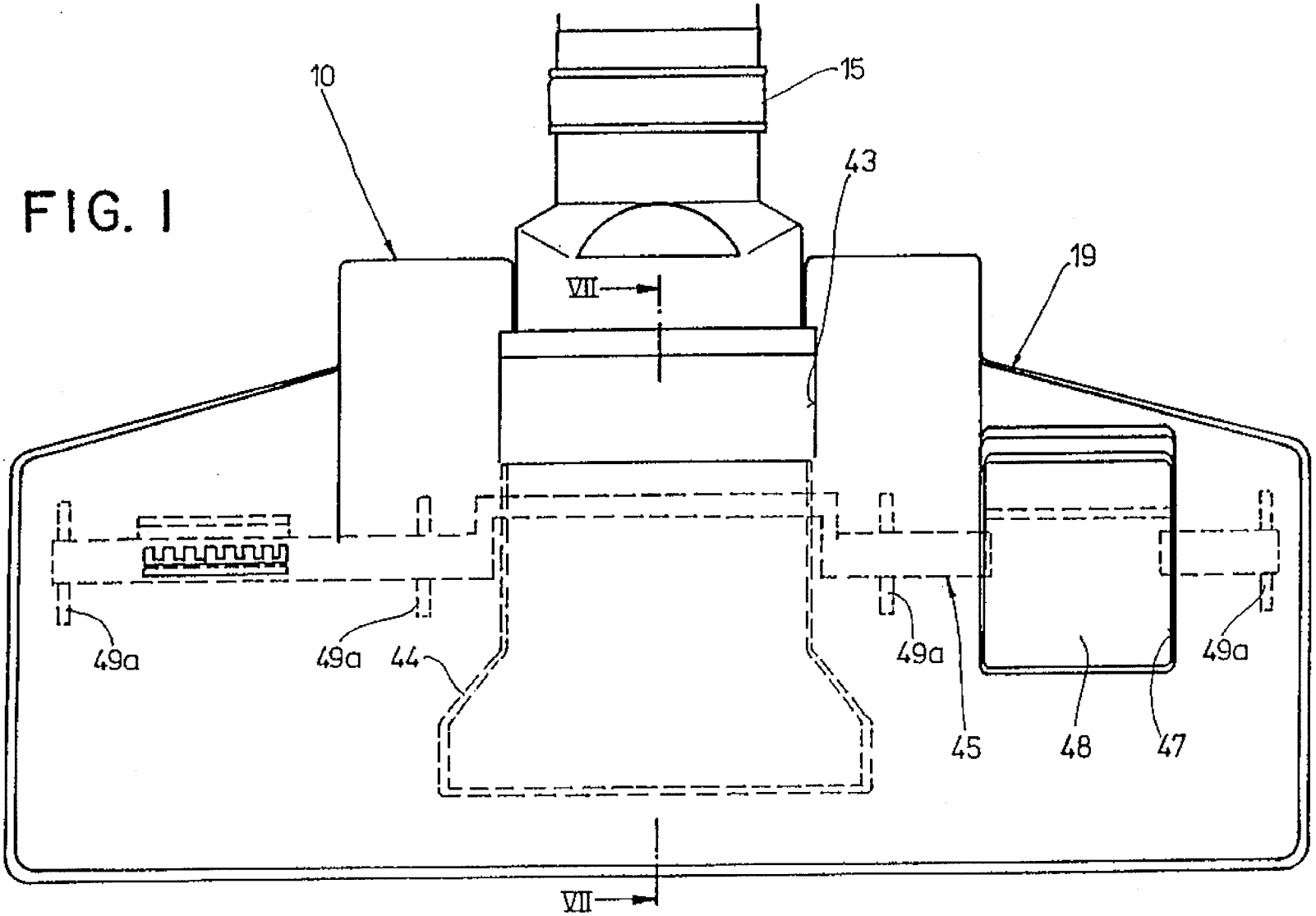
FIG. 1 shows a top view of one embodiment of a floor nozzle or a vacuum cleaner nozzle, with the inner suction channel leading from the suction pipe to the suction hole, and the actuator means for the brush-strip rocker indicated by dashed lines.

Certain basic ideas of the novel design presented by this invention related to the design of the bottom plate with two parallel suction channels, which are separated only by a plow strip and which are both connected to a single suction hole leading to the suction pipe;

the design of the central plow strip as rigid, narrow cleaning edge separating the nap, preferably with comb-like teeth on its lower marginal edge facing the nap;

the two front and rear suction edges, which enclose between them the two suction channels and the central plow strip, with rounded lower edges facing the nap, so that air can be drawn in underneath these rounded suction edges from the environment, from the front and the rear, over the full width of the suction edges;

the arrangement of a pivotal brush strip extending along a straight line from one narrow side to the other narrow side, in front of the at least two parallel suction channels;

the design of the pivot plate as carrier plate for the brush rim in the form of a rocker extending right to the journal bearings of the support wheels where it is pivoted;

the design of the journals for the support wheels as cranked axle stubs which, in addition to supporting the rocker and the support wheels, also form the pivot points for the suction pipe;

the utilization of the cranked axle stubs for setting off the pivot axis of the suction pipe to the front, away from the axis of rotation of the support wheels, for making intentional use of pressure forces applied via the handle (axle offset);

the provision of a continuous seal in the form of a projecting marginal strip in the bottom plate, which closes the suction space toward the rear, i.e. on the side of the support wheels;

the provision of lint pickup surfaces in front of and behind the two independent suction channels, centrally with respect to the floor nozzle, with the optional possibility to offset the front lint pickup surface from the area of the brush strip, which is then interrupted, into the path of the front suction channel;

the provision of open bearing blocks, facing each other, on the downwardly pointing inside of the upper part of the floor nozzle housing and the upwardly pointing inside of the bottom plate, which blocks form together the round axle bearings for the transverse pivot axis of the actuator means; further the configuration of the transition of the inner suction channel from the suction pipe to the suction hole with inclined delimiting surfaces formed by the bottom plate so that right-angle deflections of the air flow, which otherwise would be necessary, with the corresponding formation of eddy currents and losses are avoided;

the double-walled design of upper housing parts, which extend in backward direction for receiving axle stubs, with rocker arms of the pivot plate, with fork-like ends, extending back into these double walls right to the axle stubs and being snap-mounted on and supported by the latter, thereby simultaneously acting as snap rings for the axle stubs; and finally the configuration of the pivot axis for the actuator means with an actuation rocker which is accessible from the outside provided on one side and indication means that are visible through the transparent housing provided on the other side, for indicating the respective position occupied at any time by the pivot plate.

Figure 2:
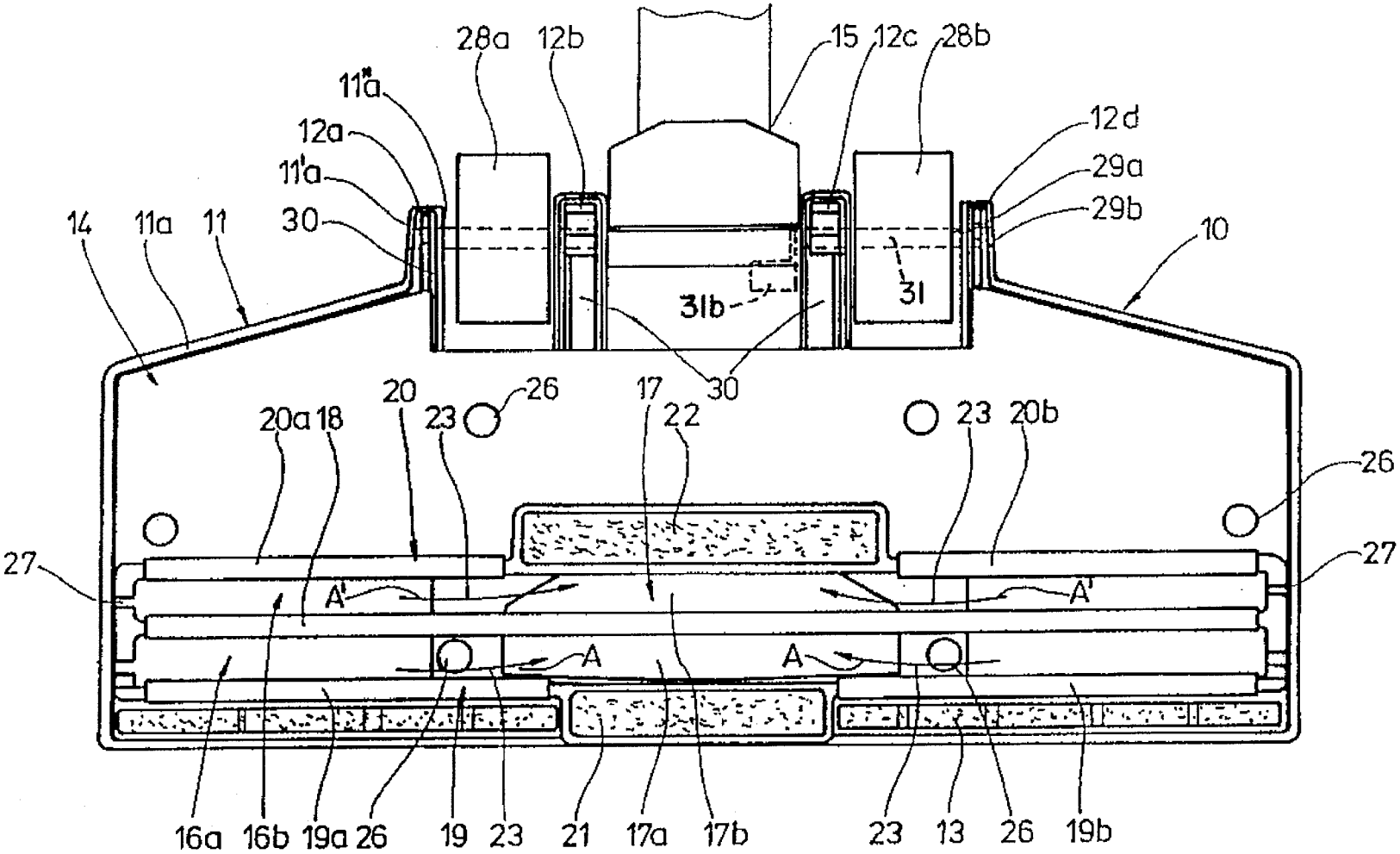
FIG. 2 shows a bottom view of the embodiment of a floor nozzle according to FIG. 1 (first embodiment of the invention)
Figure 4:
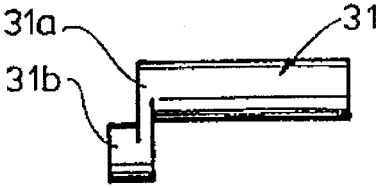
FIG. 4 shows the representation of a cranked journal serving as bearing for the support wheels and, simultaneously, the pivot plate.

The floor nozzle 10, of which FIGS. 1 and 2 show top and bottom view and which can also be described as vacuum Each of the cranked axles 31 according to FIG. 4 comprises a larger longitudinal part 31*a* as bearing for the respective support wheel 28*a*, 28*b*, and an axle stub 31*b*, set off relative to the long part and serving as pivot support for the suction pipe 15.

Figure 3:
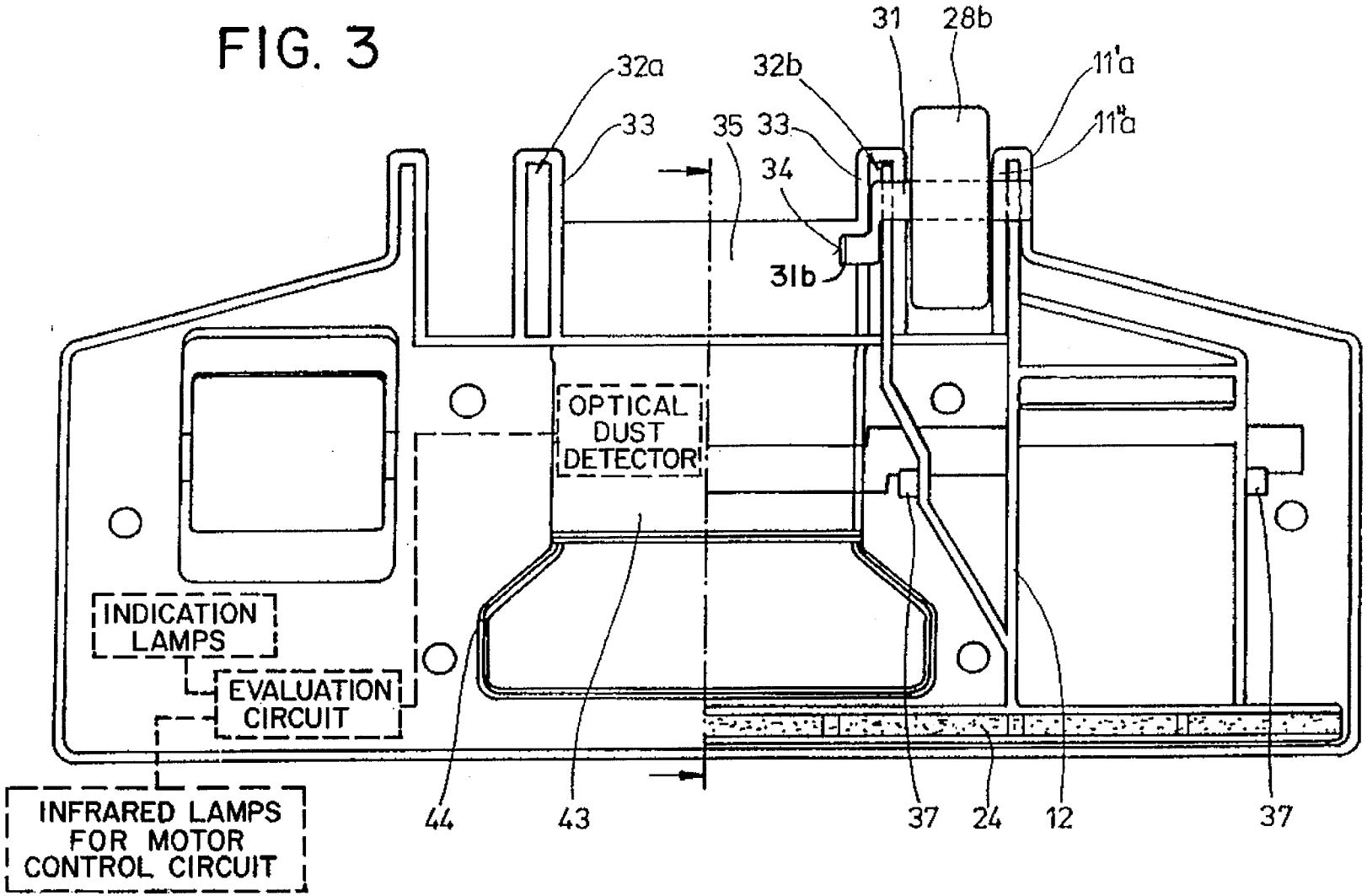
FIG. 3 shows the upper part of the housing forming the floor nozzle, viewed from the bottom, with the bottom plate removed, and with parts of the inner rocker or pivot plate, by means of which the brush strip is transferred to its active position, being visible at the right.
Figure 7:
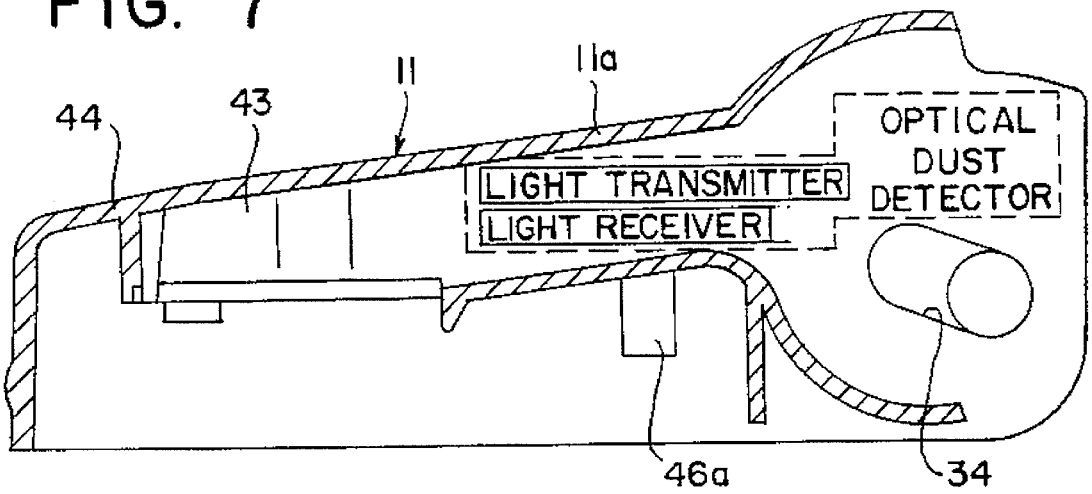
FIG. 7 shows a sectional view of the upper part of the housing of the floor nozzle, taken along line VII—VII in FIG. 1, and with the coupling pipe omitted.
Figure 8:
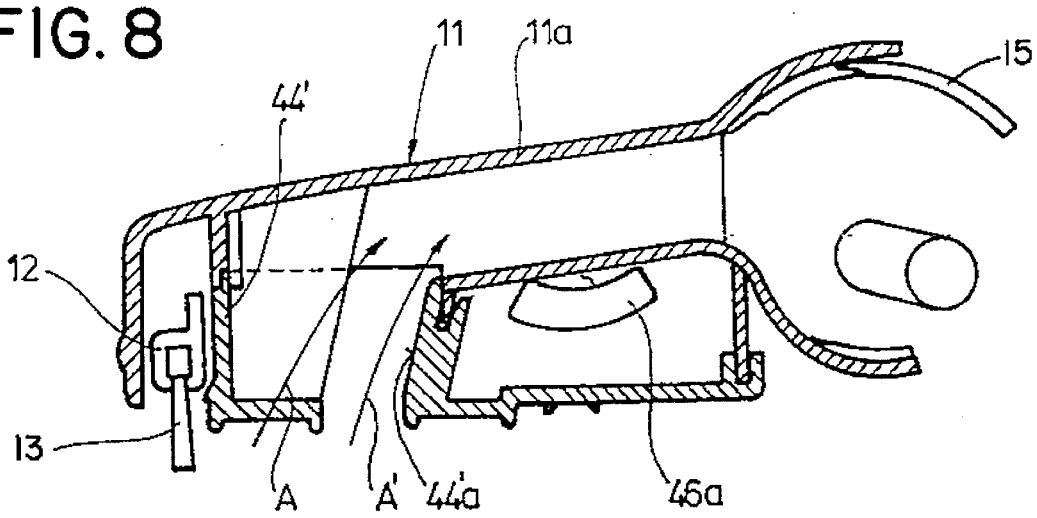
FIG. 8 shows a sectional view, similar to that of FIG. 7, of the upper housing part of a modified embodiment, where a front lint pickup means is arranged within a front suction channel in the bottom plate, with the bottom plate fitted at the bottom and with the central plate of pivot plate removed.

The lateral view of FIGS. 7 and 8, in conjunction with FIG. 3, shows that the two opposite wall portions 33 of the two inner supporting wall areas 32*a*, 32*b* of the cover part 11 comprise an oblong hole configuration 34 which enables the cranked axles 31 to be introduced from the inside into the axle holes formed by the double walls, with the support wheels 28*a*, 28*b* mounted thereon and making use of the oblong-hole configuration 34 of the inner partial walls 33, and to be pushed through at first until the outer axle stub surface of each cranked axle 31 is substantially aligned with the inner wall portions. Then the pipe 15, with its receiving blind bores, can be introduced into the space 35 between the axle bearings, whereafter the cranked axles 31 are pushed to the inside until the pipe is pivotally supported on the axle stub 31*b*. One will realize at once that this results in an approximately horizontal offset of the pivot axis of the suction pipe 15 relative to the axis of rotation of the support wheels 28*a*, 28*b* the pivot axis of the suction pipe being set off to the front by the crank length so that it is now possible for the user to apply greater contact pressure on the floor nozzle for increased cleaning efforts, by pressing more strongly on the handle and, thus, the suction pipe 15.

Figure 6:
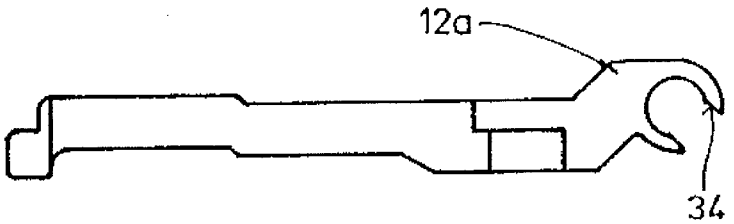
FIG. 6 shows an elevation of the pivot plate according to FIG. 5.
Figure 5:
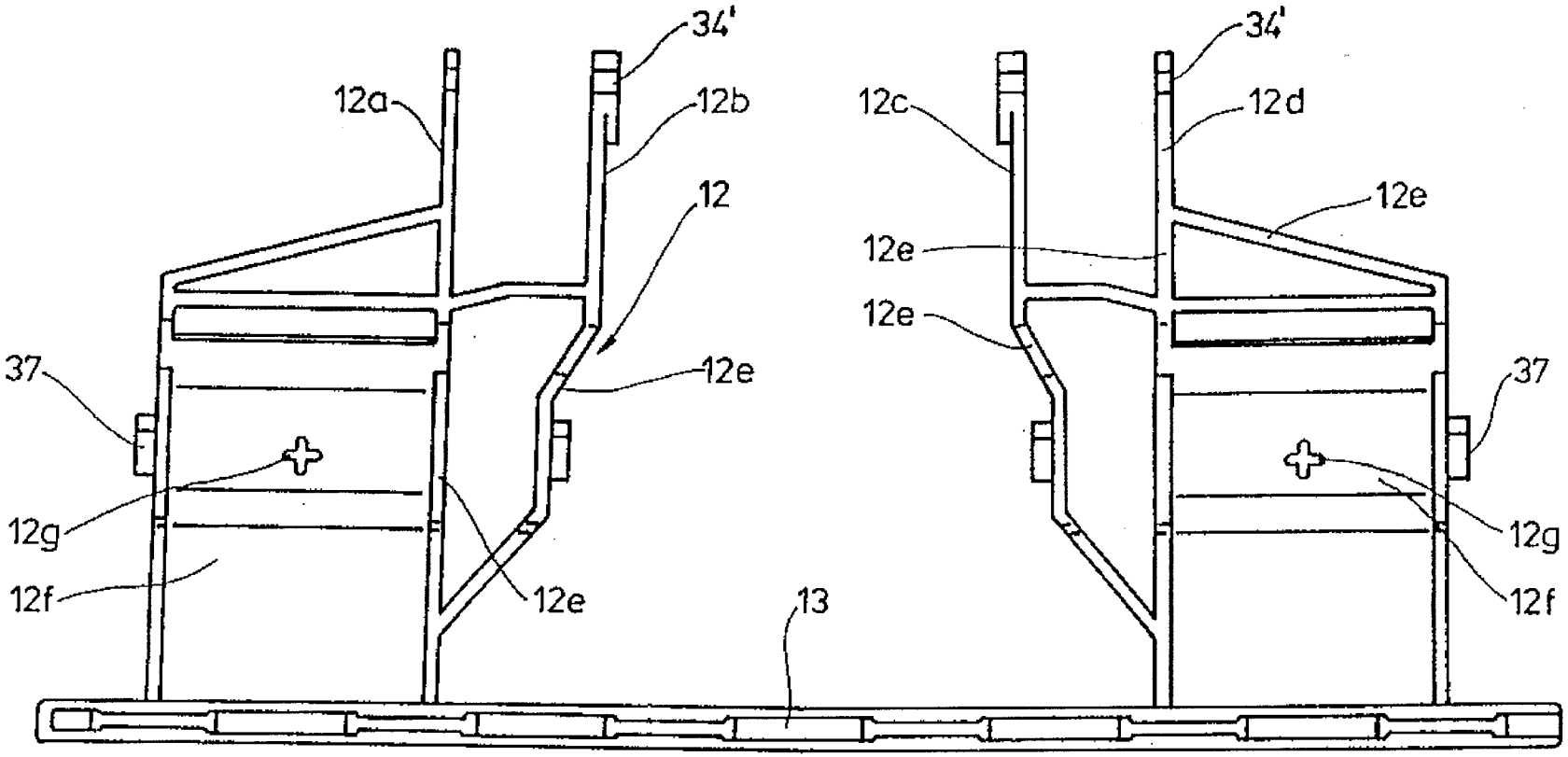
FIG. 5 shows a top view of the pivot plate carrying the brush strip and arranged as central plate of the floor nozzle.

The cranked axles have the further function of forming pivot bearings for the pivot plate 12—with the brush strip 13 fixed thereon—which is illustrated in FIG. 5 and which terminates at the rear in rocker arms 12*a*, 12*b*, 12*c* and 12*d* which—as can be seen best in the elevation of FIG. 6—point to the rear and exhibit a fork-like configuration with a throat opening 34' such that the respective throat openings 34' are passed through the free spaces 30 formed by the double walls 11*a'*, 11*a"* (FIG. 2) and into contact with the transversely extending axles 31, and are then sort of snapped on these axles. This has the result that on the one hand the pivot axis of the plate is set back a great amount so that the plate is permitted to perform a practically parallel lowering movement in the front area, with the least possible input, while on the other hand the cranked axles 31 are simultaneously fixed and locked against transverse displacement.

The pivot plate 12 may be constructed in any desired manner, preferably injection-molded from a suitable plastic material. In the case of the embodiment illustrated in FIG. 5, it comprises a plurality of reinforcing ribs 12*e* extending in forward direction, and in addition partial surfaces 12*f*, also enclosed by reinforcing ribs, which further comprise an integrally molded mounting cross 12*g* for compression springs. The pivot plate 12 is thereby pressed in upward direction. i.e. in the illustrations of FIGS. 2 and 5 toward the bottom in the drawing plane, so that in this normal position the brush strip 13 fixed to the pivot plate 12 remains in its retracted position inside the floor nozzle. In the normal position of the nozzle plate, the lower ends of the compression springs 36 (FIG. 9) rest against the inner face of the bottom plate which latter is screwed to the cover part 11.

The inner configuration of the suction channel of the floor nozzle can be seen best in the representations of FIGS. 1, 3, in conjunction with the cross-sectional view of FIG. 7. Starting at the pivotally mounted suction pipe 15, the box-shaped inner suction channel 43 extends to the front and terminates—regarding for the moment only the cover part 11—in an outwardly opening rim 44 formed by the said part 11. Starting from the rim 44 (see FIG. 8), an inwardly directed rim 44' projecting from the bottom plate 14 and mating with the rim 44 takes over the air flow and guides it to a subdivided suction hole opening 17*a*, 17*b*, as can be seen best in the cross-sectional view of FIG. 8. As has been mentioned before, the suction opening 17 may transition to the suction channels 16*a*, 16*b* by inclined surfaces 23 opening in downward direction into the suction channels in the form of a funnel. Further, the bottom plate 14 is provided with inclined wall portions 44*a'* which—as can be seen best in FIG. 8—enable the air flow to be deflected—as indicated by arrows A, A'—from the front suction channel 16*a* and the rear suction channel 16*b* to the suction pipe without any trouble and with the least possible eddy currents and, thus, losses. In effect, the upper cover part 11 and the bottom plate 14 are connected by means of inclined labyrinth seals.

Figure 10:
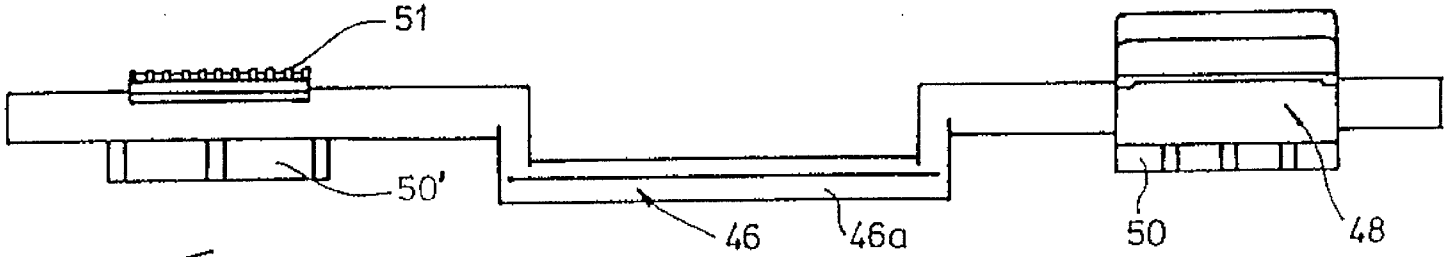
Figure 11:
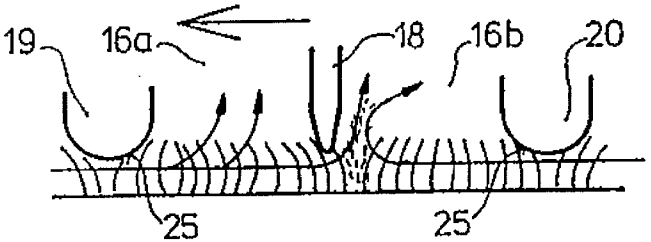
FIG. 11 shows a diagram illustrating more clearly the suction effects achieved by the central plow strip and the rounded front and rear cleaning edges adjoining it on both sides.

Switching-over of the pivot plate 12 is effected by means of an actuator device 45 (see FIG. 1) consisting essentially of the pivot axis 46 illustrated in FIG. 10. The pivot axis 46 comprises a central cranked portion 46*a* which is guided around the box shape of the inner suction channel (see FIG. 7) and which comprises, on one side of the cover part 11, a rocker 48, which is accessible through an opening 47 in the cover part 11 and which also can be foot-operated.

The pivot axis 46 is held at different points by open bearing blocks 49*a* (FIG. 1) with semicircular recesses, provided on the cover part and on the bottom plate, respectively. When the bottom plate is mounted, the two partial bearing blocks then form a closed hole for the pivot axis 46.

Figure 9:
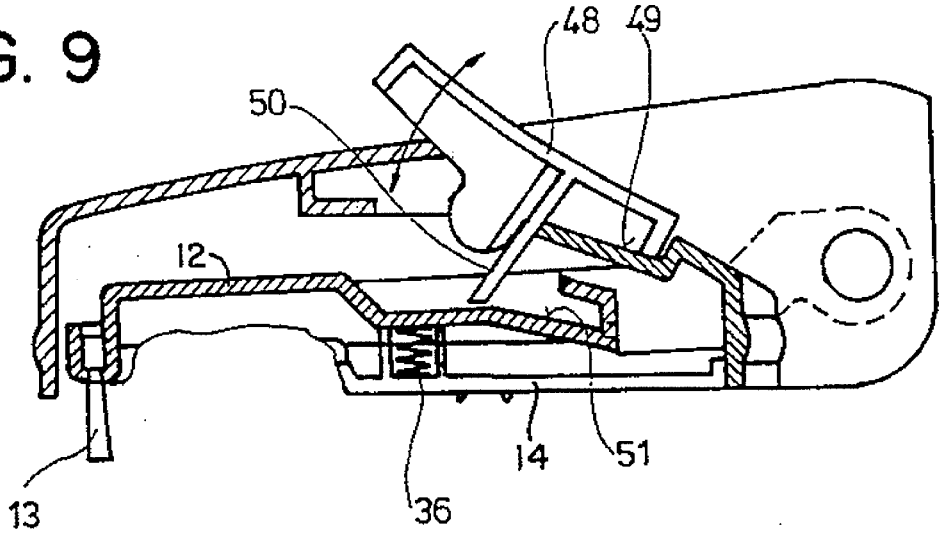
FIG. 9 shows a sectional view similar to that of FIGS. 7 and 8, with certain components omitted (in the area of the suction channel and the plow strip) for improved clarity of the representation of the rocker of the actuator means and its operation on the pivot plate.

Sliding surfaces 50 projecting from the pivot axis in downward direction—in the normal position of the floor nozzle 10—move along a counter-face 51 of the pivot plate 12—as illustrated in FIG. 9—until they get into contact with a stop that may be formed for the rocker 48 for example by a bent-off wall portion 49 of the upper cover part, whereby the brush strip 13 is pushed into its lower projecting position, against the pressure of the biasing spring 36.

It is understood that these inclined sliding faces 50 exist on both sides of the pivot axis 46; in the area of the rocker 48, these inclined surfaces 50, which are responsible for the movement of the pivot plate, may consist of projections integrally formed with the rocker 48; on the opposite side, there is provided a suitable integrally formed pressure surface 50' acting on a counter-surface of the pivot plate 12. It is of advantage if the position occupied at any time by the pivot plate 12 is indicated on the outside; therefore, an additional suitable pivot surface 51 is provided as indicating means, which carries suitable markings or symbols and which can be seen through the transparent cover part.

Figure 12:
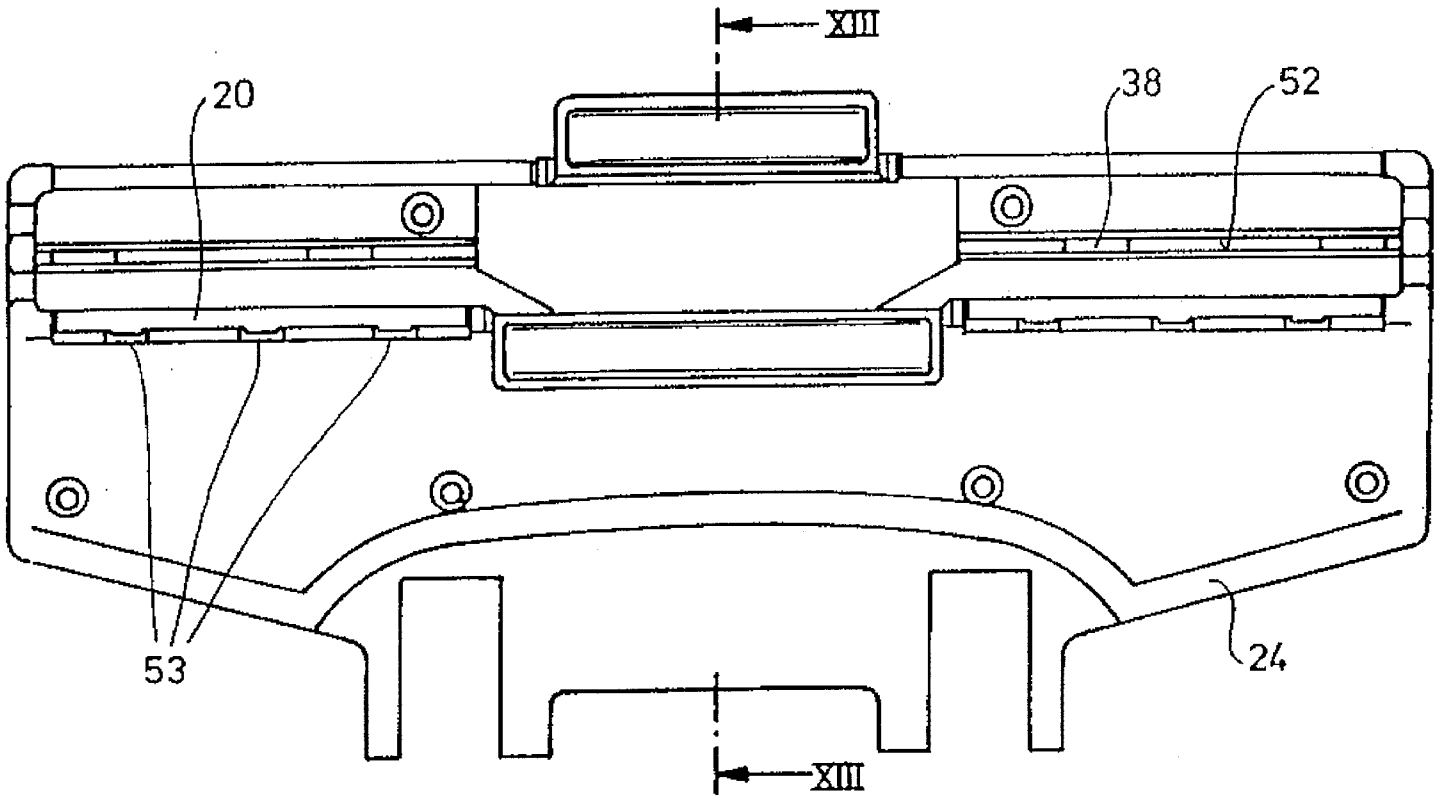
FIG. 12 shows a modified view of the bottom plate, with the central plow strip not yet installed.

Since, preferably, all the before-mentioned parts are made from a suitable strong, maybe transparent plastic material, it is recommendable to provide the cleaning edges 19, 20—as shown in FIG. 2 and FIG. 12—with fitted metallic sliding profiles, well adapted to their rounded contours.

Finally, a further development consists in arranging an optical dust detector inside the suction channel, for measuring the respective dust flow rate. Such an optical dust detector is known as such and consists usually of at least one light transmitter (infrared diodes) and at least one light receiver (phototransistor), whose output signals are supplied to an evaluation circuit. Due to the detected dust quantities, the evaluation circuit is triggered repeatedly and prevented from flipping to a second state.

Consequently, the evaluation circuit may comprise at least one bistable or monostable element which is repeatedly triggered by the dust signals produced, and which in its one position activates a first indication lamp and in its other position activates another indication lamp so that the user can easily see, at a clearly visible point of the floor nozzle, if the area presently worked by him with the vacuum cleaner is still dusty so that it should be further worked, or if he should proceed to another flooring area.

Figure 13:
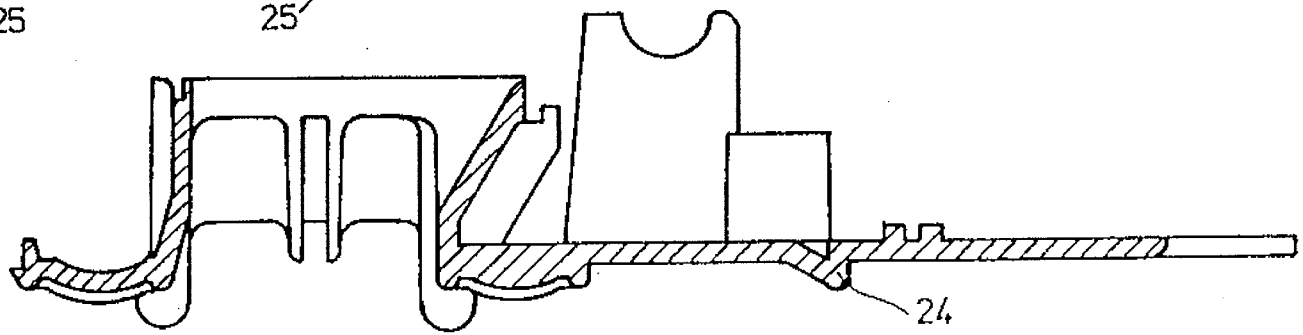
FIG. 13 shows a sectional view of the bottom plate according to FIG. 12, taken along line XIII—XIII.

In FIG. 12, showing a bottom view of the bottom plate of one embodiment of the invention, one can also clearly see the sealing lip 24, which preferably is formed integrally with the bottom plate and which in the operative condition projects in downward direction (see also FIG. 13) so that the suction space is almost tightly closed. FIG. 12, in conjunction with FIG. 14, also show that the central plow strip 18 preferably is configured as a separate part and provided with snap-on legs 37*a*, 37*b* with laterally projecting noses, which legs are arranged opposite each other and located in matching openings 38 of a receiving groove 52 for a plow strip 18.

Figure 14:
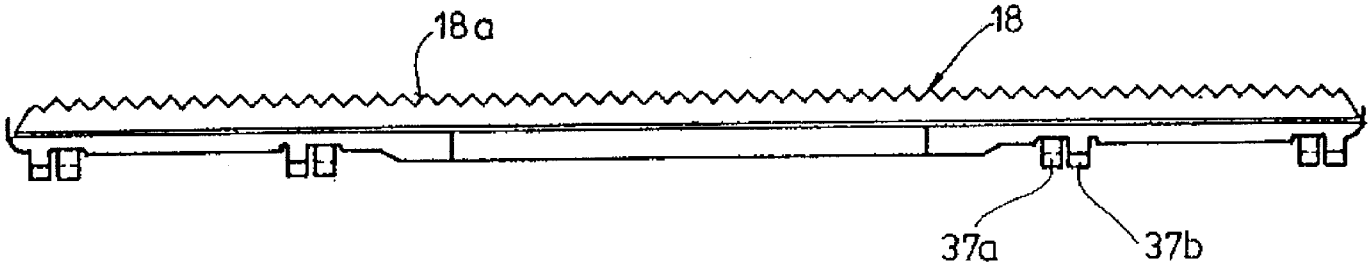
FIG. 14 finally shows an elevation of a preferred embodiment of a plow strip, illustrating the lateral snap-on hooks by which it can be fitted in a receiving groove in the bottom plate.

FIG. 14 shows the preferred embodiment of the central plow strip, with its downwardly directed comb-like, i.e. toothed or serrated, structure 18*a*, which further supports the separating effect on the nap. The air flow, which is responsible for the cleaning effect of the plow strip 18, is taken in from both sides and passes underneath the rounded shape 25 of the front and rear cleaning edges 19, 20.

For certain special reasons, it may also be of advantage to interrupt the plow strip in the area of the suction opening 17. The bordering 24, acting as an air brake, is suited especially for hard floorings. Lastly, it should be mentioned that the claims, and especially the main claim, are attempts at putting the invention into words without a comprehensive knowledge of the prior art and therefore without limiting prejudice. The right to regard all features presented in the description, the claims, and the drawings, both individually and in any combination, as essential to the invention, and to record them in the claims, is therefore reserved, as is the right to reduce the features contained in the main claim.

I claim:

1. A floor nozzle for vacuum cleaners, comprising:

a housing;

a pivot plate;

a vertically adjustable brush strip supported on said pivot plate;

a bottom plate;

an intermediate strip for opening a nap to be cleaned;

front and rear suction channels separated by said intermediate strip and arranged in said bottom plate and extending transversely to a direction along which the floor nozzle is to be pushed to effect any of a forward and backward movement, said front suction channel being defined by a front cleaning edge, said rear suction channel being defined by a rear cleaning edge, each of said front and rear cleaning edges being rounded for sliding across the nap during any of the forward and backward movement of the floor nozzle on the nap; and support means arranged on the housing for providing swivel support of a suction pipe, wherein the intermediate strip is arranged between said front and rear cleaning edges for opening the nap to be cleaned, said intermediate strip being configured as an elongated lip for penetrating into the nap, bending individual fibers of the nap over according to the direction of movement of the floor nozzle across the nap, and separating the nap in directions toward the front and rear suction channels depending on the direction of movement of the floor nozzle in one of a forward and backward direction as the front and rear cleaning edges slide across the nap.

2. A floor nozzle according to claim 1, wherein the front and the rear cleaning edges exhibit a rounded configuration, facing the surface to be cleaned and sliding thereon, with no other support or sliding surfaces formed on the bottom plate.

3. A floor nozzle according to claim 1, wherein said front and rear cleaning edges, as well as said intermediate strip, extend outwardly relative to the remaining surfaces of said bottom plate.

4. A floor nozzle according to claim 1, wherein the intermediate strip exhibits any one of a toothed and comb-like configuration.

5. A floor nozzle for vacuum cleaners, comprising:

a housing;

a pivot plate;

vertically adjustable brush strip supported on said pivot plate;

a bottom plate;

an intermediate strip for opening a nap to be cleaned;

front and rear suction channels separated by said intermediate strip and arranged in said bottom plate and extending transversely to a direction along which the floor nozzle is to be pushed to effect any of a forward and backward movement, said front suction channel being defined by a front cleaning edge, said rear suction channel being defined by a rear cleaning edge, each of said front and rear cleaning edges being rounded for sliding across the nap during any of the forward and backward movement of the floor nozzle on the nap;

support means arranged on the housing for providing swivel support of a suction pipe, wherein the intermediate strip is arranged between said front and rear cleaning edges for opening the nap to be cleaned, penetrating into the nap, bending individual fibers of the nap over according to the direction of movement of the floor nozzle across the nap, and separating the nap in directions toward the front and rear suction channels depending on the direction of movement of the floor nozzle in one of a forward and backward direction as the front and rear cleaning edges slide across the nap, said support means including support wheels rotatably connected to said housing so as to be rotatable about an axis; and a handle pipe connected to the floor nozzle via a pivot axis, said pivot axis being set off to the front relative to the axis of rotation of the support wheels in a manner such that pressure applied by an operator, via the handle pipe, results in additional contact pressure between the floor nozzle and the surface to be cleaned than is otherwise present.

6. A floor nozzle according to claim 1, wherein a projecting edge in the form of a sealing lip is provided in the bottom plate.

7. A floor nozzle according to claim 1, wherein said brush strip for working hard floorings is arranged in front of said suction channels, viewed in the forward direction of movement of said floor nozzle.

8. A floor nozzle according to claim 7, wherein said brush strip is interrupted by a first front lint pickup pad and another lint pickup pad is arranged behind said rear cleaning edge, both said pickup pads being located adjacent the middle of said floor nozzle.

9. A floor nozzle according to claim 7, further including an upper cover part positioned above and connected to said bottom plate, wherein said pivot plate for lowering said brush strip is arranged between said upper cover part and said bottom plate.

10. A floor nozzle according to claim 9, wherein said cover part and said bottom plate are connected by means of inclined seals designed to substantially eliminate eddy currents.

11. A floor nozzle according to claim 9, wherein said cover part is configured to form an inner box-like suction channel terminating at a rim extending in an upward direction from said bottom plate, to form a suction hole split up into two partial suction holes.

12. A floor nozzle according to claim 11, wherein said rim formed on said bottom plate and terminating by the two partial suction holes is inclined in an inward and rearward direction for forming gradually curved guide surfaces for the air flow, thus avoiding the production of troublesome eddy currents.

13. A floor nozzle according to claim 1, further including an upper cover part folded on both sides of said support means to form bearing walls.

14. A floor nozzle according to claim 13, wherein said bearing walls comprise doubled bearing wall portions between which are formed free spaces, said support means including cranked bearing axles that extend through said doubled bearing wall portions and through said free spaces, said pivot plate including rocker arms projecting from said pivot plate and extending in a rearward direction into said free spaces, said rocker arms having throat openings embracing said bearing axles.

15. A floor nozzle according to claim 14, wherein said cranked bearing axles include axle stubs set off relative to the axis of said cranked bearing axles, said axle stubs projecting toward each other to form a pivot bearing for a suction pipe to be positioned in and supported by said support means, said axle stubs being aligned along an axis positioned between the axis of said cranked bearing axles and said suction channels.

16. A floor nozzle according to claim 14, wherein said throat openings of said rocker arms projection from said pivot plate are snap-locked on said cranked bearing axles so as to fix said cranked bearing axles against lateral displacement.

17. A floor nozzle according to claim 14, wherein said pivot plate is supported below by said bottom plate via compression springs, and is pivotally operated by switching means in the form of an actuator rocker accessible from the outside of said floor nozzle, said actuator rocker having a pivot axis extending over the width of said floor nozzle and actuating said pivot plate by sliding faces coacting with counter-surfaces of said pivot plate.

18. A floor nozzle according to claim 17, wherein the pivot axis of said actuator rocker is rotatably seated in bearing block halves formed in said cover part and said bottom plate, respectively, and provided with a central cranked portion by which said actuator rocker passes around an inner suction channel formed by said cover part.

19. A floor nozzle according to claim 1, wherein said front and rear suction channels meet to form an inner suction channel, said floor nozzle further including an optical dust detector, comprising a light transmitter and a light receiver, arranged in said inner suction channel and followed by an evaluation circuit which actuates different indication lamps, that are visible from the outside of said floor nozzle, in response to the dust flow rate, with an off-the-line power supply unit arranged inside said floor nozzle.

20. A floor nozzle according to claim 19, wherein said evaluation circuit, which is controlled by the optical dust detector, comprises transmitter means whose output signal is received by a control circuit controlling the vacuum cleaner motor, for regulating the vacuum cleaner power.

21. A floor nozzle according to claim 20, further including an all-round infrared transmitter for emitting dust detector signals from the floor nozzle, and at least two infrared lamps arranged to emit light to the outside of said floor nozzle.

22. A floor nozzle according to claim 1, wherein said intermediate strip is interrupted in the central bottom region of said suction channels.

23. A floor nozzle according to claim 1, wherein said elongated lip configuration of said intermediate strip includes a tapering toward a free pointed end of said intermediate strip for facilitating creation of a digging-in effect into the nap by the free pointed end of the intermediate strip.

* * * * *